US009770090B2

(12) United States Patent
Chen

(10) Patent No.: US 9,770,090 B2
(45) Date of Patent: Sep. 26, 2017

(54) TOOTHBRUSH WITH FRONT-PUSH REPLACEABLE BRUSH HEAD

(71) Applicant: SUBAYU INDUSTRIAL CO., LTD., New Taipei (TW)

(72) Inventor: Shih-Hao Chen, New Taipei (TW)

(73) Assignee: SUBAYU INDUSTRIAL CO., LTD., New Taipei (TW)

( * ) Notice: Subject to any disclaimer, the term of this patent is extended or adjusted under 35 U.S.C. 154(b) by 136 days.

(21) Appl. No.: 15/007,998

(22) Filed: Jan. 27, 2016

(65) Prior Publication Data

US 2017/0208930 A1 Jul. 27, 2017

(51) Int. Cl.
*A46B 7/04* (2006.01)
*A46B 5/00* (2006.01)

(52) U.S. Cl.
CPC ..... *A46B 7/04* (2013.01); *A46B 5/0095* (2013.01); *A46B 7/042* (2013.01); *A46B 7/044* (2013.01)

(58) Field of Classification Search
CPC ..... A46B 7/04; A46B 7/042; A46B 7/044; A46B 7/046; A46B 7/048; A46B 5/0095
USPC ..... 15/145, 176.1, 176.4–176.6, 202
See application file for complete search history.

(56) References Cited

U.S. PATENT DOCUMENTS 1,631,013 A * 5/1927 Cosby ..... A46B 7/04 15/176.4
6,134,743 A * 10/2000 Schmidt ..... A47L 13/022 15/111

FOREIGN PATENT DOCUMENTS

| | | | |
|---|---|---|---|
| EP | 601574 | * | 6/1994 |
| FR | 634455 | * | 2/1928 |
| FR | 2595221 | * | 9/1987 |

* cited by examiner

*Primary Examiner* — Mark Spisich
(74) *Attorney, Agent, or Firm* — Chun-Ming Shih; HDLS IPR Services

(57) ABSTRACT

A toothbrush with a front-push replaceable brush head includes a handle portion, a handle front section connected to the handle portion and having a supporting platform, a front-push mechanism including a pulling arm pivotally attached to the handle portion and push and locking plates stacked together penetrating the handle front section, the pulling arm driving the push and locking plates to move; a brush head replaceably installed on the supporting platform, the locking plate locked onto the brush head and handle front section; the pulling arm is pulled and rotated to move the locking and push plates toward the brush head and to release the locking plate, handle front section and brush head from locking while the push plate pushing the brush head away from the supporting platform. Therefore, the release of locking and disengagement of the brush head are achieved simultaneously to facilitate operations of the toothbrush.

10 Claims, 7 Drawing Sheets

TOOTHBRUSH WITH FRONT-PUSH REPLACEABLE BRUSH HEAD

BACKGROUND OF THE INVENTION

Field of the Invention

The present invention is related to a toothbrush, in particular, to a toothbrush with a front-push replaceable brush head.

Description of Related Art

Most of the toothbrushes currently available in the market are typically made of plastic materials, and their life spans are approximately three months. After the brush bristles on the toothbrush contact with the teeth for a period of time, it would cause a certain degree of wear out such that the performance of cleaning is reduced and is prone to the growth of bacteria; therefore, it must be discarded after a period of time, which causes not only the waste of resources but also the concerns of endangering the environmental protection.

To effectively improve the aforementioned problem, manufacturers in the industry provides the design of toothbrushes with replaceable brush heads, which mainly comprises a handle portion and a brush head connected to the handle portion. The brush head comprises a base connected to the handle portion and a brush plate disposed with brush bristles thereon; wherein the base and the brush plate respectively include an insertion slot and an insertion portion in order to allow the brush plate with brush bristles to be inserted into the base such that a toothbrush with a replaceable brush head can be constructed.

However, for the toothbrush with the replaceable brush head, the following problem is still found during the actual process of use. Since it uses the insertion slot for securement, after a period of time of use, the insertion hole tends to become loose such that the condition of falling off is likely to occur.

SUMMARY OF THE INVENTION

An objective of the present invention is to provide a toothbrush with a front-push replaceable brush head, which utilizes the pulling and rotation of the pulling arm in order to achieve the release of locking and withdrawal for disengagement of the brush head; therefore, the convenience of the operation of the toothbrush is further increased.

To achieve the aforementioned objective, the present invention provides a toothbrush with a front-push replaceable brush head, comprising a handle portion, a handle front section, a front-push mechanism and a brush head. The handle front section is connected to the handle portion, and the handle front section includes a supporting platform. The front-push mechanism comprises a pulling arm pivotally attached to the handle portion as well as a push plate and a locking plate stacked onto each other and penetrating through the handle front section. The pulling arm is used for driving the push plate and the locking plate to move forward and backward. The brush head is replaceably installed on the supporting platform, and one end of the locking plate locked onto the brush head and the handle portion front section. Wherein the pulling arm is pulled and rotated to allow the locking plate and the push plate to move in a direction toward the brush head and to allow the locking plate, the handle front section and the brush head to release from locking while allowing push plate to push the brush head to move in a direction away from the supporting platform for withdrawal.

The present invention is also of the following effects. The locking effect can be achieved by the protruding hook of the pulling arm and the indented groove of the driven member being locked onto each other. The utilization of the semi-circular gear of the pulling arm and the gear rack of the driven member are engaged to move with each other such that the stability of the actuation is increased. With the assistance of the elastic hooks pushed by the slanted push surface, the effect of effort saving can be achieved.

DETAILED DESCRIPTION OF THE INVENTION

Figure 1:
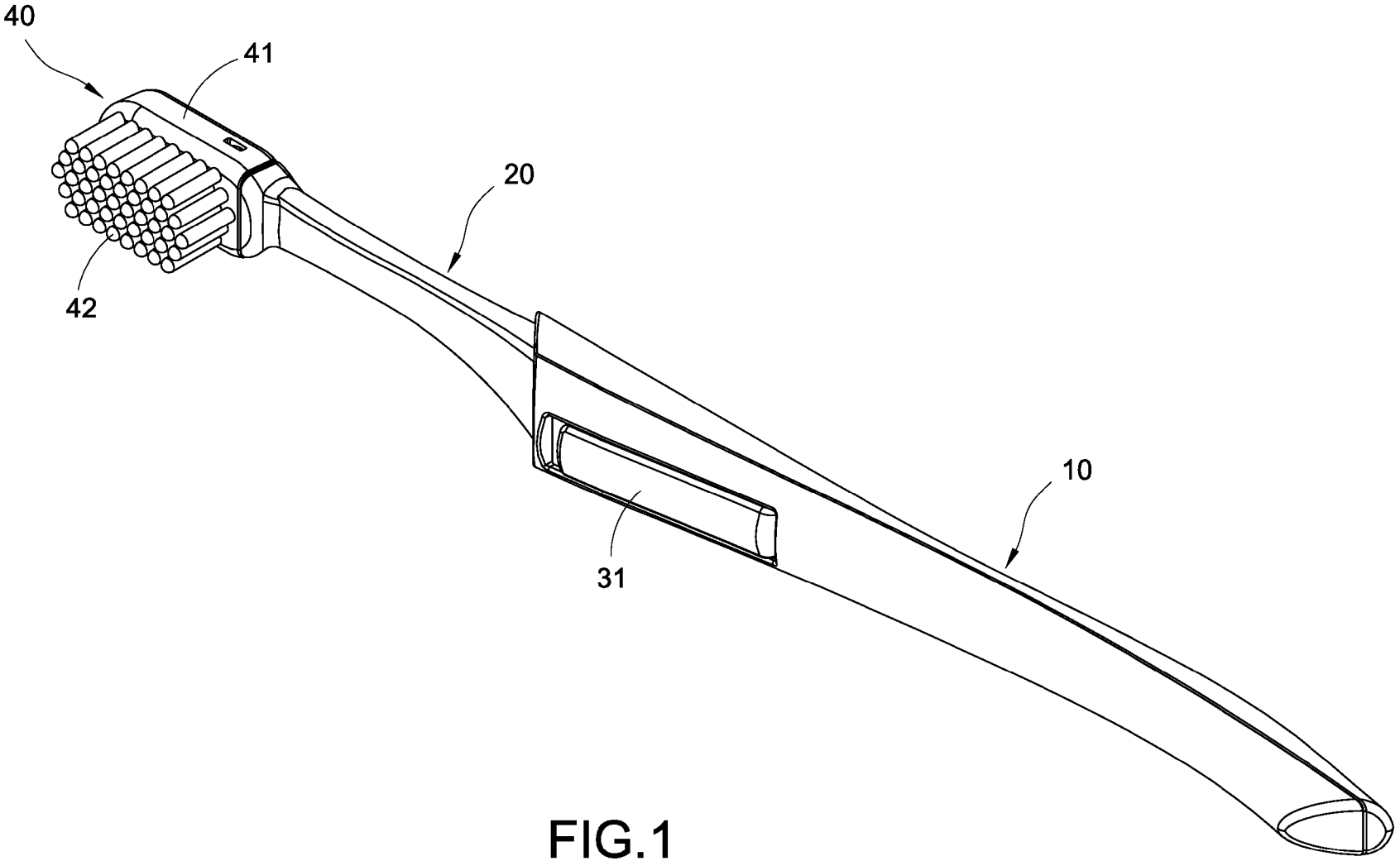
FIG. 1 is a perspective exploded view of the toothbrush with a front-push replaceable brush head of the present invention.
Figure 2:
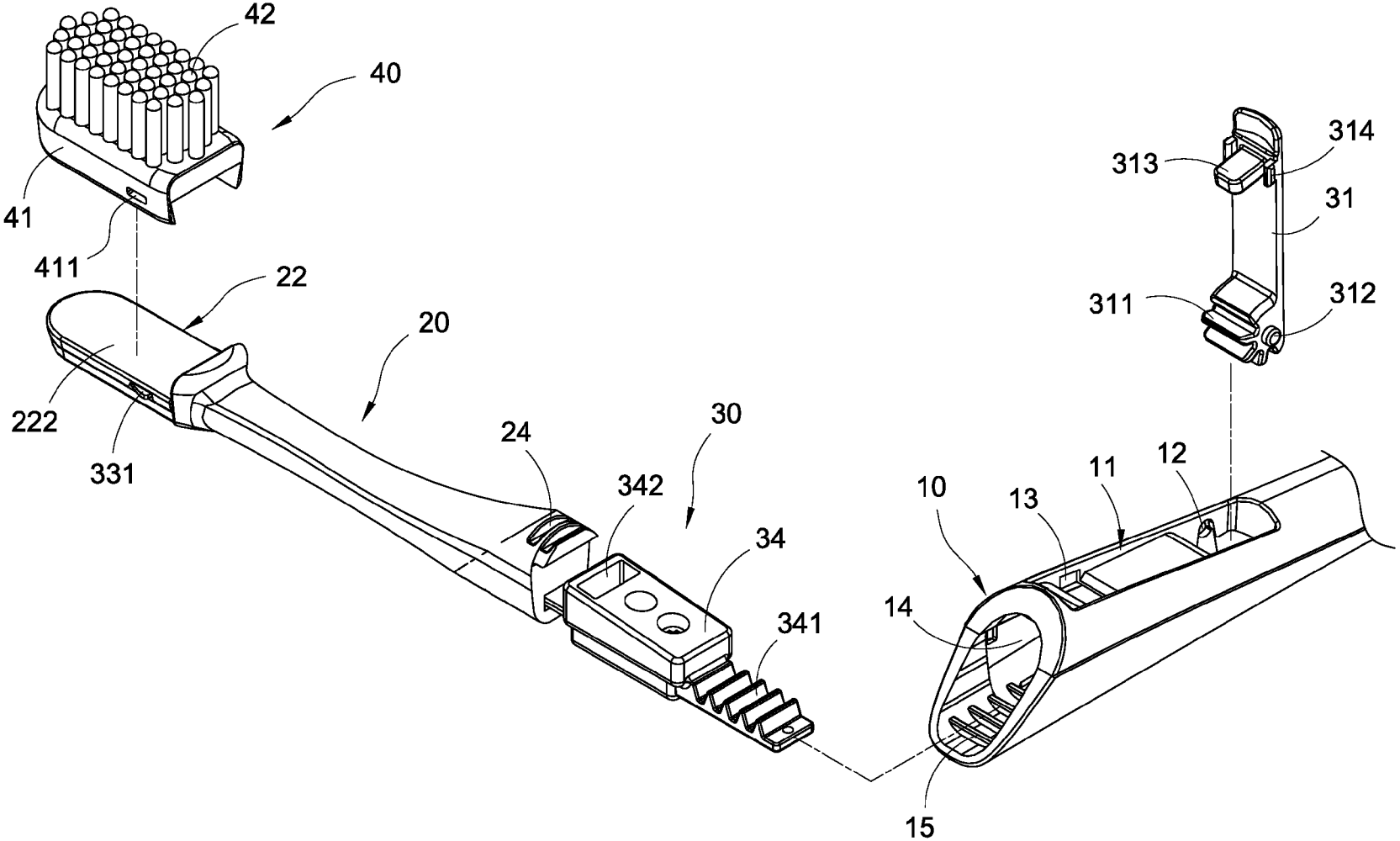
FIG. 2 is an exploded view of the toothbrush with a front-push replaceable brush head of the present invention.

The following provides a detailed description on the embodiments and technical content related to the present invention along with the accompanied drawings. However, it shall be understood that the accompanied drawings are provided for illustration purposes only and shall not be treated as limitations of the present invention.

Please refer to FIG. 1 to FIG. 5. The present invention provides a toothbrush with a front-push replaceable brush head, mainly comprising a handle portion 10, a handle front section 20, a push mechanism 30, and a brush head 40.

The handle portion 10 can be an elongated body made of a plastic material. The external of the front side of the handle portion 10 includes a rectangular receiving slot 11. A pivotal attachment hole 12 is formed at a lower end of the receiving slot 11, and a locking slot 13 is formed at an upper end of the receiving slot 11. In addition, the front end of the handle portion 10 includes an accommodating chamber 14 formed thereon and connected to the receiving slot 11. A lower side location of the inner wall of the accommodating chamber 14 includes a plurality of lower locking strips 15 formed thereon and arranged spaced apart from each other and an upper side location of the inner wall thereof includes a plurality of upper locking strips 16 formed thereon.

Figure 3:
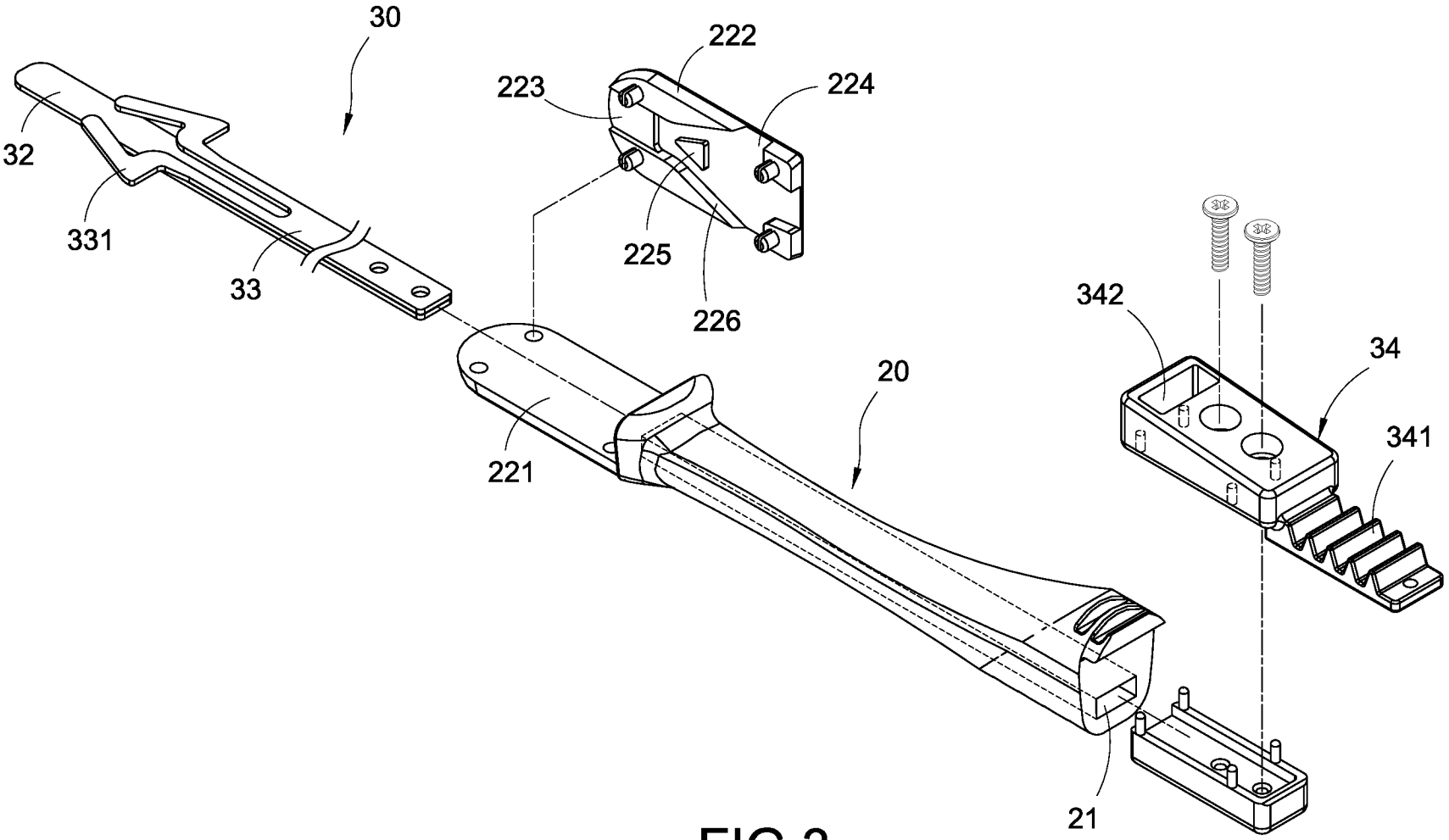
FIG. 3 is an exploded view of the handle front portion and the front-push mechanism of the present invention.
Figure 4:
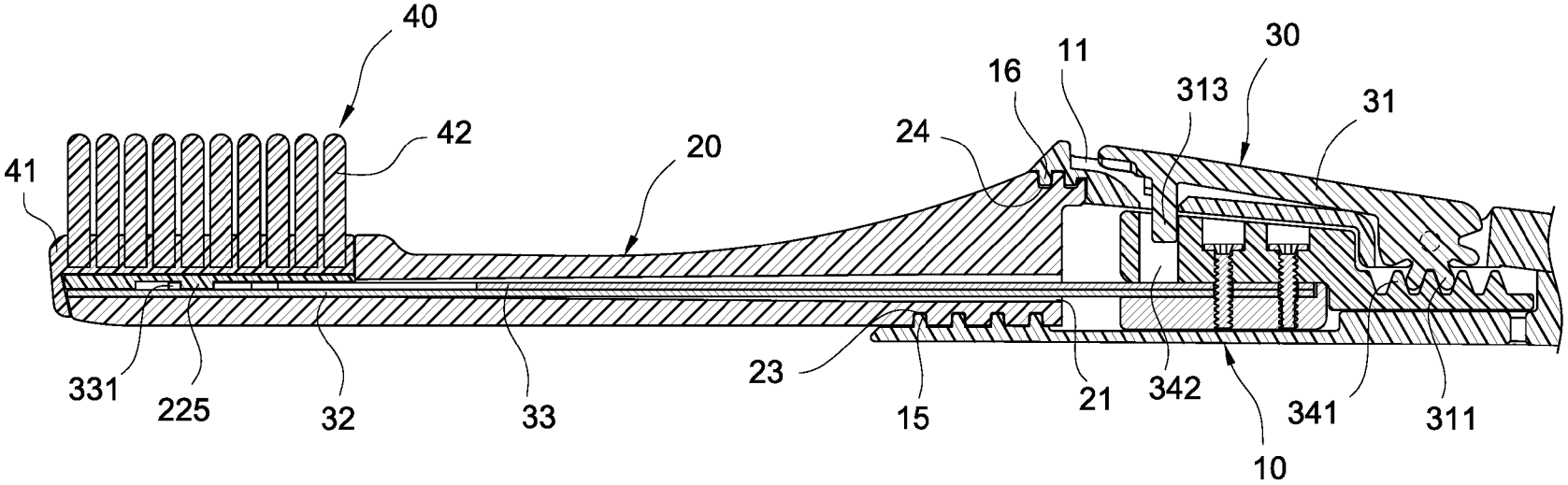
FIG. 4 is an assembly cross sectional view of the toothbrush with a front-push replaceable brush head of the present invention.

The handle front section 20 is connected to the handle portion 10 and is formed at the front side of the handle portion 10. The handle front section 20 can also be made of a plastic material, and it includes a through hole 21 formed along the length direction and configured to allow the through hole to penetrate in a front to rear manner (as shown in FIG. 3). In addition, the front side of the handle front section 20 includes a supporting platform 22. The supporting platform 22 comprises a lower base board 221 and an upper base board 222 configured to cover and secure onto the lower base board 221 correspondingly. The end surface of the upper base board 222 facing toward the lower base board 221 includes a longitudinal through slot 223 and a lateral through slot 224 connected to the longitudinal through slot 223 formed thereon. Furthermore, the middle section of the longitudinal through slot 223 includes a triangular block 225 protruded therefrom, and a slanted push surface 226 is respectively formed along two sides of the triangular block 225 to the location of the lateral through slot 224. Furthermore, the lower surface of the rear side of the handle front section 20 includes a plurality of lower locking grooves 23 formed thereon (as shown in FIG. 4), and each one of the lower locking grooves 23 is provided for the aforementioned each one of the lower locking strips 15 to lock and secure thereon respectively. The upper surface of the rear side of the handle front section 20 includes a plurality of upper locking grooves 24 formed thereon, and each one of the upper locking grooves 24 is provided for the aforementioned each one of the upper locking strips 16 to lock and secure thereon respectively The front-push mechanism 30 mainly comprises a pulling arm 31, a push plate 32, a locking plate 33 and a driven member 34. The pulling arm 31 is installed corresponding to the aforementioned receiving slot 11. The lower end of the pulling arm 31 includes a semi-circular gear 311, and two sides of the semi-circular gear 311 includes a pivotal axle 312 extended therefrom respectively. Each one of the pivotal axles 312 is pivotally attached onto the aforementioned corresponding pivotal attachment holes 12 respectively. In addition, the upper end of the pulling arm 31 includes a protruding hook 313 formed thereon respectively, and two sides of the protruding hook 313 include a locking hook 314 formed thereon respectively. Each one of the locking hooks 314 is locked and secured onto the aforementioned locking slot 13 correspondingly.

The push plate 32 and the locking plate 33 are both elongated plates made of a metal material. The front end of the locking plate 33 includes a pair of elastic hooks 331, and each one of the elastic hooks 331 is formed of a triangular shape. The locking plate 33 is stacked on top of the push plate 32 and both penetrates through the aforementioned through hole 21 together. The front section of the push plate 32 and each one of the elastic hooks 331 are received inside the aforementioned longitudinal through slot 223 and the lateral through slot 224. Each one of the elastic hooks 331 is formed between the aforementioned triangular block 225 and each one of the slanted push surface 226. In addition, the hooking end of each one of the elastic hook 331 exposes to the outer portion of the lateral through slot 224 respectively.

The driven member 34 is clamped onto one end of the push plate 32 and the locking plate 33 away from the elastic hooks 331 and is received inside the aforementioned accommodating chamber 14. The driven member 34 includes a gear rack 341 engaged to move with the aforementioned semi-circular gear 311 and includes an indented groove 342 formed on one end away from the gear rack 341 to allow the aforementioned protruding hook 313 to insert therein.

Figure 5:
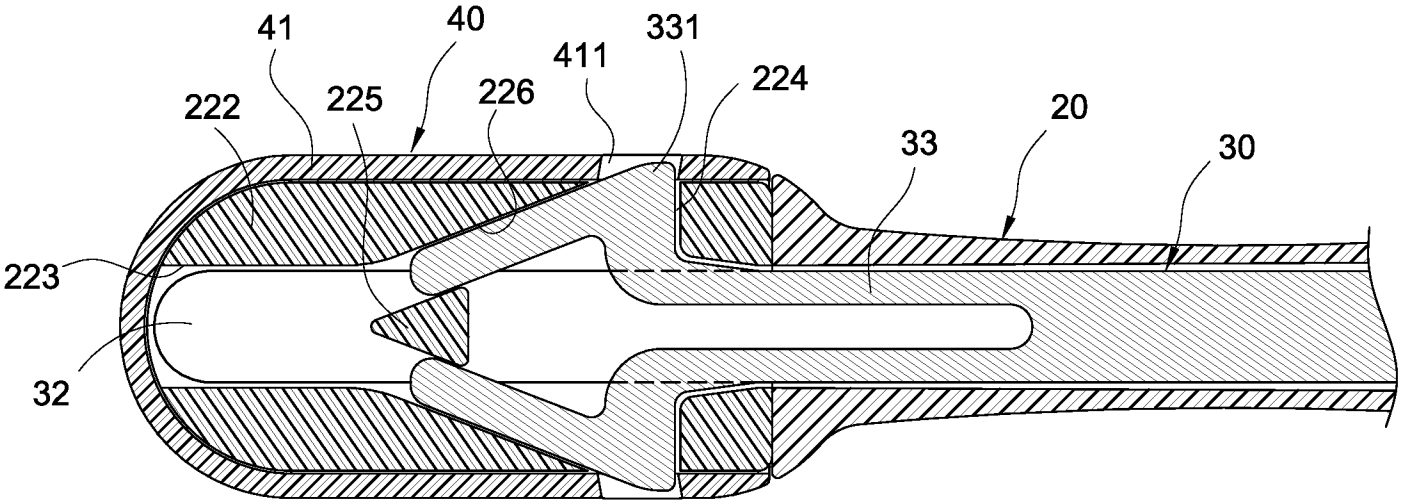
FIG. 5 is an assembly cross sectional view of the front-push mechanism and the brush head of the present invention.

The brush head 40 includes a brush head base 41 and a plurality of brush bristles 42 disposed on the brush head base 41. The brush head base 41 is replaceably installed on the aforementioned supporting platform 22. The two sides of the brush head base 41 respectively include a locking slot 411 formed at a location corresponding to the aforementioned lateral through slot 224. Each one of the aforementioned elastic hooks 331 is locked inside the lateral through slot 224 and the locking slot 411 for securement thereof (as shown in FIG. 5).

Figure 6:
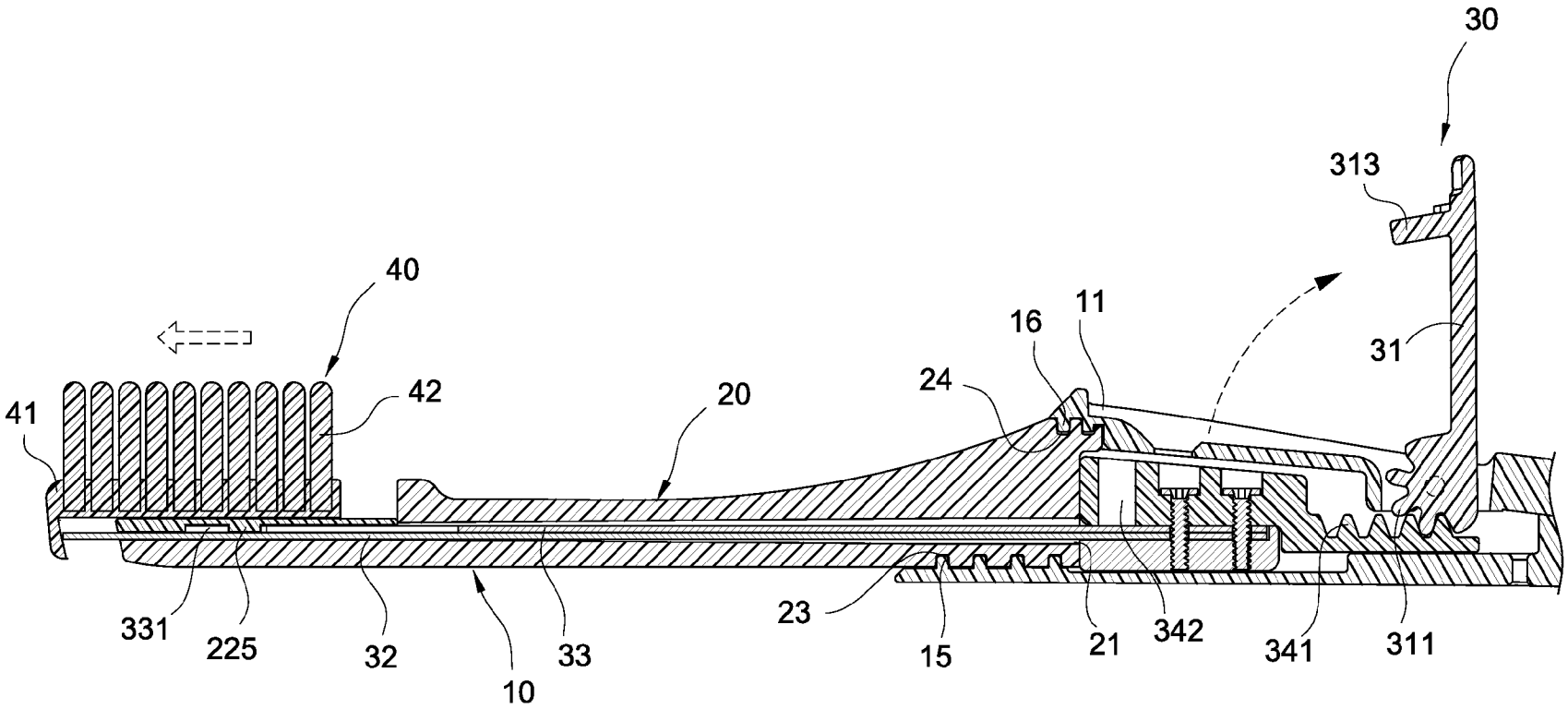
FIG. 6 is a state-of-use cross sectional view (1) showing a state of use of the toothbrush with a front-push replaceable brush head of the present invention.
Figure 7:
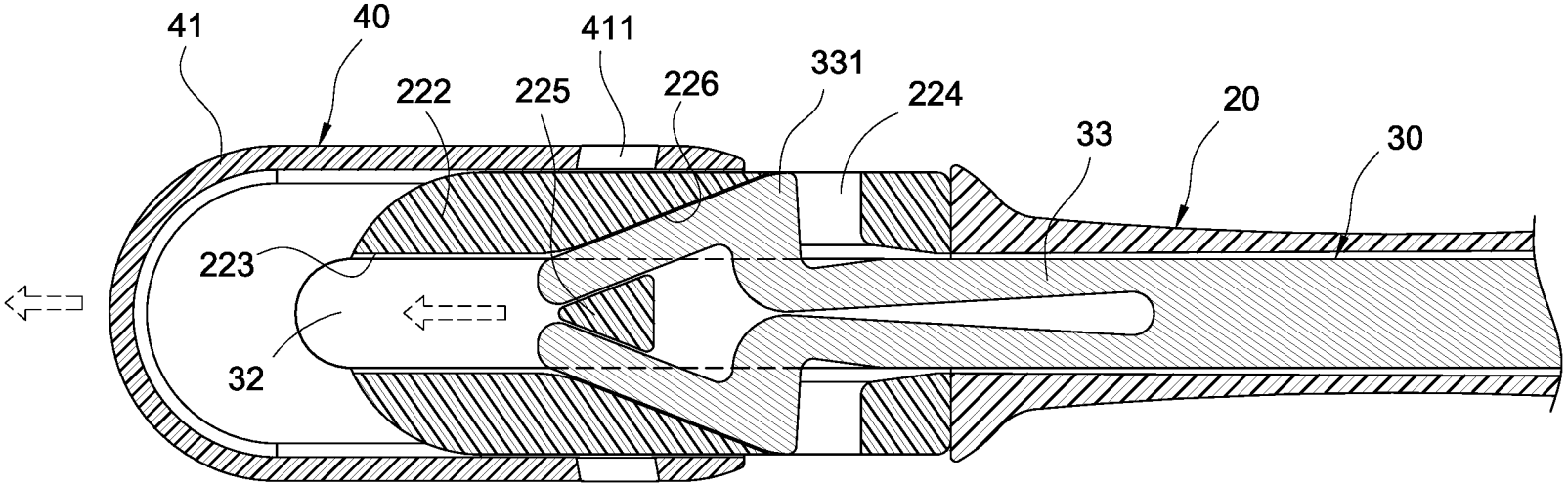
FIG. 7 is a state-of-use cross sectional view (2) showing another state of use of the toothbrush with a front-push replaceable brush head of the present invention.

Please refer to FIG. 6 and FIG. 7. During the use of the present invention, each one of the pivotal attachment axles 312 of the pulling arm 31 is used as a rotational center to pull and rotate the pulling arm 31 upward. At this time, the semi-circular gear 311 of the pulling arm 31 pushes the gear rack 341 of the driven member 34 to move in a direction toward the handle front section 20 while simultaneously driving the push plate 32 and the locking plate 33 to move toward the front; wherein each one of the elastic hooks 331 of the locking plate 33 is retracted inward due to the push by the slanted push surface 226 such that the handle front section 20 and the brush head base 41 of the brush head 40 are disengaged from the locking by each one of the elastic hooks 331. At the same time, the push plate 32 pushes the brush head base 41 of the brush head 40 to move in a direction away from the supporting platform 22 in order to disengage therefrom for withdrawal.

In view of the above, the toothbrush with a front-push replaceable brush head of the present invention is able to achieve the expected objectives of use while overcoming the drawbacks of the prior arts, which is of novelty and inventive step as well as complies with the requirement for the application of an invention patent. The present invention is, therefore, legitimately applied and seeks for the grant of the patent right for protection of the invention and the right of the inventor.

What is claimed is:

1. A toothbrush with a front-push replaceable brush head, comprising:

a handle portion;

a handle front section connected to the handle portion, the handle front section having a supporting platform;

a front-push mechanism comprising a pulling arm pivotally attached to the handle portion as well as a push plate and a locking plate stacked onto each other and penetrating through the handle front section; the pulling arm used for driving the push plate and the locking plate to move forward and backward; and a brush head replaceably installed on the supporting platform, one end of the locking plate locked onto the brush head and the handle portion front section;

wherein the pulling arm is pulled and rotated to allow the locking plate and the push plate to move in a direction toward the brush head and to allow the locking plate, the handle front section and the brush head to be released from locking while the allowing push plate to push the brush head to move in a direction away from the supporting platform for withdrawal.

2. The toothbrush with a front-push replaceable brush head according to claim 1, wherein the handle portion includes a receiving slot; the receiving slot includes a pivotal attachment hole and a locking slot formed therein; the pulling arm is installed corresponding to the receiving slot; the pulling arm includes a pivotal axle and a locking hook extended therefrom; the pivotal axle is attached to the pivotal attachment hole correspondingly, and the locking hook is locked onto the locking slot correspondingly.

3. The toothbrush with a front-push replaceable brush head according to claim 2, wherein the handle portion includes an accommodating chamber connected to the receiving slot; an inner wall of the accommodating chamber includes a plurality of lower locking strips formed thereon and arranged spaced apart from each other; the handle front section includes a plurality of lower locking grooves; each one of the lower locking strips is locked and secured onto each one of the lower locking grooves.

4. The toothbrush with a front-push replaceable brush head according to claim 3, wherein the handle front section includes a plurality of upper locking grooves; an inner wall of the accommodating chamber forms a plurality of upper locking strips spaced apart from each other; each one of the upper locking strips is locked and secured onto each one of the upper locking grooves.

5. The toothbrush with a front-push replaceable brush head according to claim 1, wherein the front-push mechanism further comprises a driven member; the driven member is clamped onto one end of the push plate and the locking plate; the pulling arm includes a semi-circular gear; the driven member includes a gear rack engaged to move with the semi-circular gear.

6. The toothbrush with a front-push replaceable brush head according to claim 5, wherein the pulling arm includes a protruding hook formed thereon; the driven member includes an indented groove provided for the protruding hook to lock and secure thereon.

7. The toothbrush with a front-push replaceable brush head according to claim 1, wherein the handle portion includes a through hole; the locking plate and the push plate penetrates through the through hole to reach the supporting platform.

8. The toothbrush with a front-push replaceable brush head according to claim 7, wherein the supporting platform comprises a lower base board and an upper base board correspondingly covered onto the lower base board; the upper base board includes a longitudinal through slot and a lateral through slot connected to the longitudinal through slot; an end portion of the locking plate includes a pair of elastic hooks formed thereon; a front section of the push plate and each one of the elastic hooks are received inside the longitudinal through slot and the lateral through slot.

9. The toothbrush with a front-push replaceable brush head according to claim 8, wherein an internal portion of the longitudinal through slot includes a triangular block protruded therefrom; a slanted push surface is formed along two sides of the triangular block to reach the lateral through slot respectively; each one of the elastic hooks is formed between the triangular block and each one of the slanted push surface.

10. The toothbrush with a front-push replaceable brush head according to claim 9, wherein the brush head includes a brush head base; the brush head base includes a pair of locking slots, and a hooking end of each one of the elastic hooks exposes out of the lateral through slot to lock onto each one of the locking slots.

* * * * *